US006494180B1

(12) United States Patent
Schlossarczyk

(10) Patent No.: US 6,494,180 B1
(45) Date of Patent: Dec. 17, 2002

(54) IMPLEMENT HAVING SPEED REGULATION

(75) Inventor: Jörg Schlossarczyk, Winnenden (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/654,422

(22) Filed: Sep. 1, 2000

(30) Foreign Application Priority Data

Sep. 3, 1999 (DE) ..... 199 41 981

(51) Int. Cl.[7] ..... F02M 7/12
(52) U.S. Cl. ..... 123/392; 261/69.2; 261/DIG. 68
(58) Field of Search ..... 123/392, 437; 261/35, 69.2, DIG. 68

(56) References Cited

U.S. PATENT DOCUMENTS 4,007,717 A * 2/1977 Scott ..... 123/392
4,041,911 A * 8/1977 Steele et al. ..... 123/392
4,787,356 A * 11/1988 Rösgen et al. ..... 261/DIG. 68
4,796,578 A * 1/1989 Nagasaka et al. ..... 123/378

* cited by examiner

*Primary Examiner*—Andrew M. Dolinar
(74) *Attorney, Agent, or Firm*—R W Becker & Associates; R W Becker

(57) ABSTRACT

A manually guided implement having an internal combustion engine is provided. A fuel/air mixture is supplied to the internal combustion engine via a diaphragm carburetor. The engine is cooled by a cooling fan that is driven by the internal combustion engine and that generates an air stream. The diaphragm carburetor has a fuel-filled control chamber with a control diaphragm which on that side facing away from the control chamber delimits a compensation chamber. To limit speed, a control pressure line is provided between the compensation chamber and the air stream generated by the cooling fan.

11 Claims, 4 Drawing Sheets

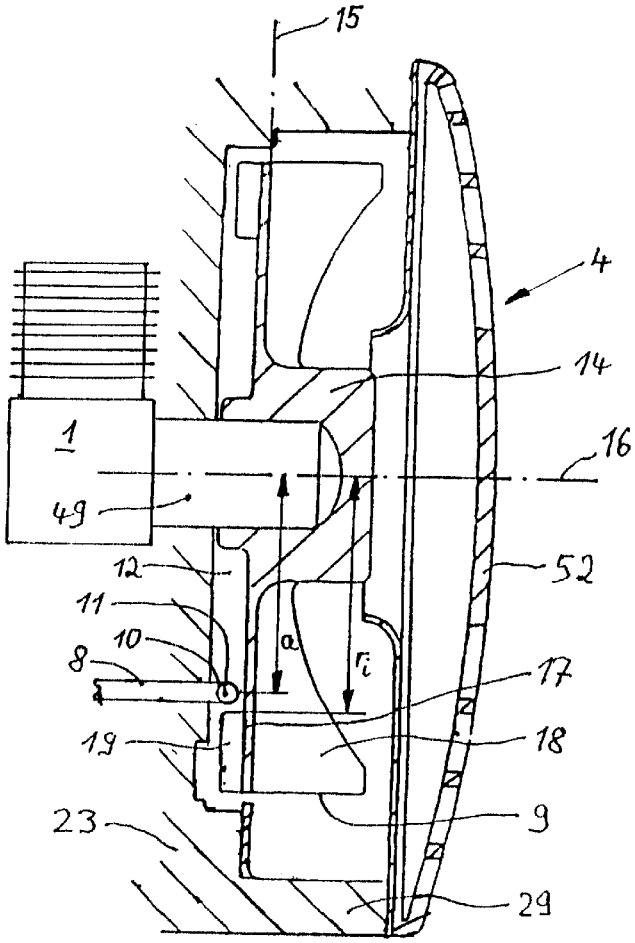
Fig. 4
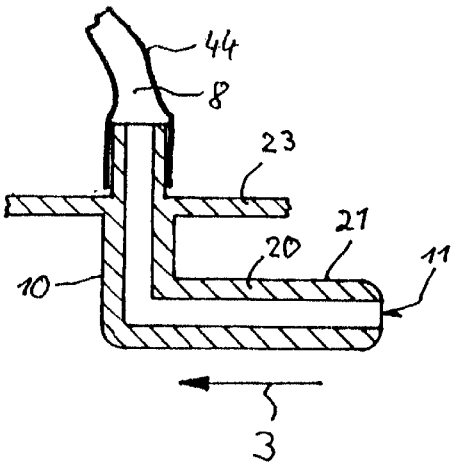
Fig. 5
Fig. 6
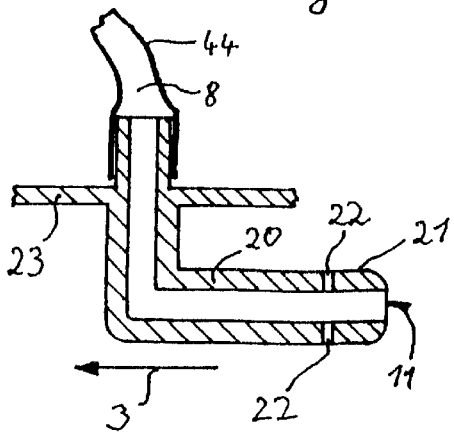

IMPLEMENT HAVING SPEED REGULATION

BACKGROUND OF THE INVENTION

The present invention relates to a manually guided implement having an internal combustion engine.

Implements such as chainsaws, brush cutters or the like are provided with a diaphragm carburetor for forming an air/fuel mixture for the internal combustion engine that drives the implement. To set a desired mixture ratio of the air/fuel mixture, the diaphragm carburetor is provided with a mixture setting device that includes a main nozzle and an idling nozzle. The fuel throughput through the nozzles, and hence the mixture ratio, is a function of pressure in the venturi section of the intake channel and can, within prescribed limits, be adapted via adjustment screws. The nozzles are supplied from a fuel-filled control chamber that is supplied with fuel via a feed valve that is controlled by a control diaphragm. In order to keep the preset mixture ratio constant as a function of a variable reference pressure, there is provided on the dry side of the control diaphragm a compensation chamber that is supplied with the reference pressure. The reference pressure can, for example, be the ambient pressure, which is dependent upon the weather or site of use, or can be the intake pressure on the clean air side of an intake air filter, with such intake pressure being dependent upon how dirty the air filter is.

These implements, at a high output of the internal combustion engine and a low emission of pollutants, are operated with a lean setting of the mixture ratio. However, at high speeds a lean setting can lead to increased thermal stress.

Internal combustion engines, especially two-stroke engines, that are set lean additionally tend to reach high speeds at full throttle without the application of an external load. If during operation the external load, for example, suddenly drops, and if the operator reduces the fuel feed only with a time delay, the internal combustion engine can reach damaging excess speeds.

In practice two-stroke engines are therefore set richer in the full throttle range, as a result of which not only the thermal stress is reduced, but the maximum speed is also lowered. The drawback of a richer mixture setting is the loss of power that inherently results, and also the increased fuel consumption.

To limit the maximum speed of a two-stroke engine, mechanical regulators, which are controlled by centrifugal force, or electronic regulators are known, according to which when a prescribed speed is exceeded, this speed is reduced by suppressing the ignition. The drawback of such regulators is that they become effective only after the prescribed speed has been exceeded. After the regulation process has started, the speed is then again reduced to a value at which the regulator is no longer active. The speed again increases until the regulation process is again initiated. An internal combustion engine, the speed of which is limited in this fashion, tends to oscillate back and forth between an upper and a lower threshold speed. A precisely defined speed limitation can therefore be achieved only with difficulty. In addition, interruption of the ignition allows unburned fuel to be discharged. If a catalytic converter is provided in the exhaust system, the fuel is after burned and an increased quantity of heat is released, which thermally stresses the catalytic converter.

It is therefore an object of the present invention to improve an implement of the aforementioned general type having an internal combustion engine in such a way that with straightforward means the fuel consumption as well as the thermal and mechanical stressing of the internal combustion engine are reduced.

BRIEF DESCRIPTION OF THE DRAWINGS

This object, and other objects and advantages of the present invention, will appear more clearly from the following specification in conjunction with the accompanying schematic drawings, in which:

FIG. 4 is a cross-sectional view through the cooling fan of FIG. 1 taken along the line IV—IV thereof;

FIG. 5 is a cross-sectional view through one exemplary embodiment of a pitot tube; and FIG. 6 is a cross-sectional view through a modified pitot tube according to FIG. 5.

SUMMARY OF THE INVENTION

Figure 1:
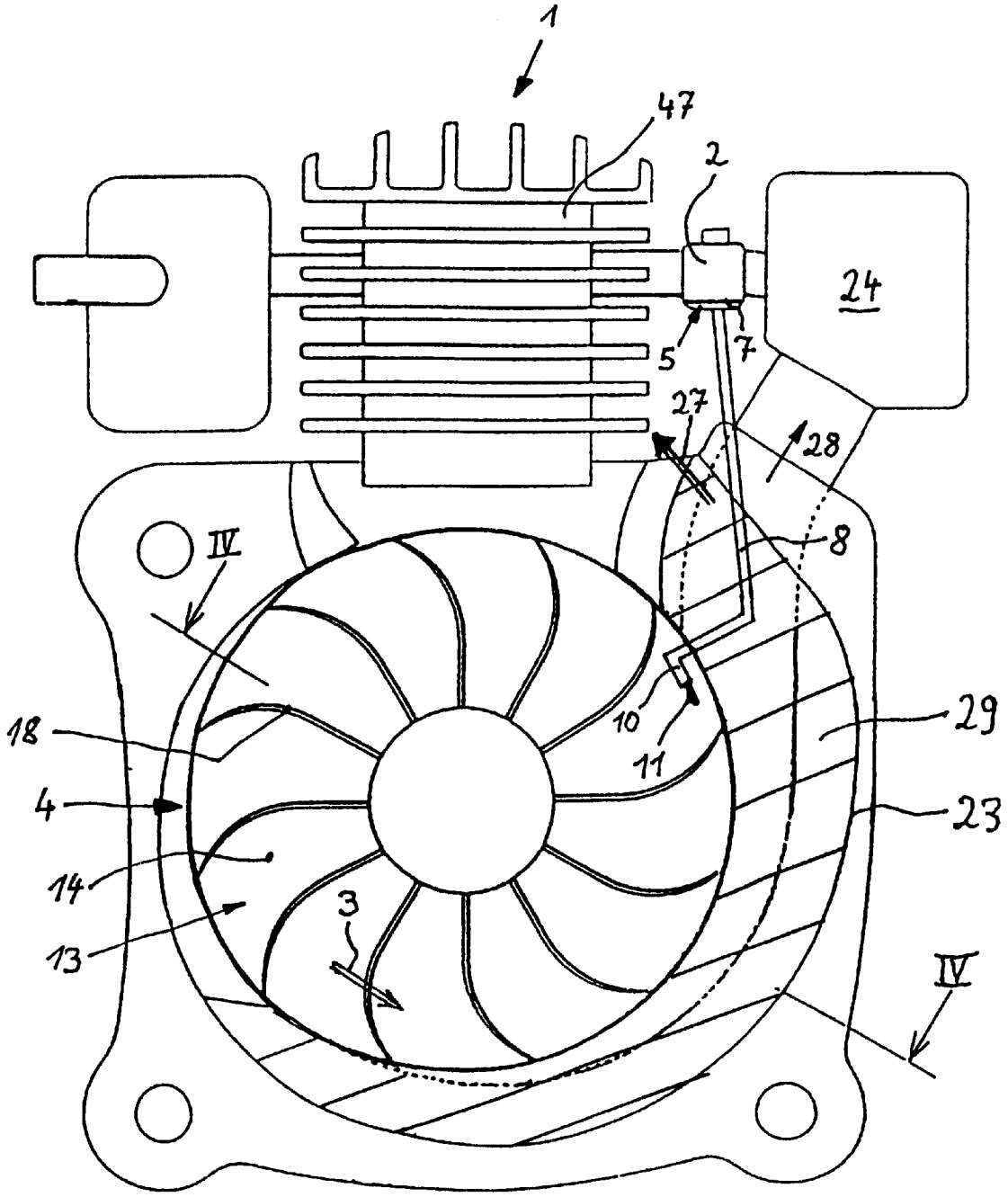
FIG. 1 shows one exemplary embodiment of an internal combustion engine for a manually guided implement.

The implement of the present invention has the following features: a diaphragm carburetor for supplying a fuel/air mixture to the internal combustion engine, wherein the carburetor has a fuel-filled control chamber, a compensation chamber and a control diaphragm that separates the two chambers; a cooling fan that is driven by the internal combustion engine and generates an air stream; and a control pressure line for establishing communication, in an air pressure transmitting manner, between a region of the air stream and the compensation chamber of the carburetor.

The basic concept of the present invention is that the air stream that is generated by a cooling fan of an implement has a pressure that depends upon the speed and with which the diaphragm regulator of the diaphragm carburetor can be supplied In such a way that as the speed increases, the air/fuel mixture can be made richer. Since with an implement of the aforementioned type not only a cooling fan but also a diaphragm carburetor having a diaphragm regulator are present, this concept is implemented with little structural expense via a control pressure line that connects a suitable region of the air stream generated by the cooling fan in a pressure transmitting manner with the compensation chamber of the diaphragm carburetor.

As a result, a leaner base setting of the mixture ratio can be selected for the low and middle speed range. At higher and maximum speeds within the operational speed range, pursuant to the present invention the mixture is enriched so greatly that on the one hand the thermal stress of the internal combustion engine remains tolerable, and on the other hand a threshold speed cannot be exceeded even without applying an external load. Since the pressure in the air stream generated by the cooling fan continuously increases with speed, the air/fuel mixture is also continuously enriched. The speed of the internal combustion engine therefore slowly approaches the prescribed threshold speed without exceeding such speed or experiencing the disadvantageous oscillation between an upper and a lower speed. Since with this type of speed limitation the ignition continues to operate, the air/fuel mixture continues to burn, thus reducing the discharge of pollutants and the thermal stressing of a catalytic converter as compared to the situation where the speed limitation is accompanied by interruption of ignition. Thus, and due to the lean presetting for low and middle speeds, on the whole, over an operating cycling comprising idling, partial load and full throttle, a reduced fuel consumption and a reduced discharge of pollutants is demonstrated.

An air cleaning mechanism is advantageously provided in the air stream; this mechanism ensures that larger dirt particles will be separated from the air stream. To achieve a high operational reliability without clogging the control pressure line, the pressure-obtaining opening that is disposed at the air stream end of the control pressure line is preferably arranged on the back side of the fan wheel, i.e. on the clean air side of the air cleaning mechanism.

For a precisely reproducible setting of the mixture ratio as a function of the speed of the internal combustion engine, a high pressure differential is desirable between the rest pressure and the speed-dependent pressure in the air stream. Since the pressure in the air stream is essentially a function of the speed of the stream; the pressure-obtaining opening of the control pressure line is preferably disposed at a location of higher speed of the air stream.

In one preferred embodiment of the present invention, the cooling fan is a radial fan having a circular disk-shaped fan disk that on one side is provided with cooling air blades. The fan disk rotates about a vertical fan axis. As a result of the rotational movement of the fan wheel, an air stream having a high tangential speed component is generated in the region of the cooling air blades. In addition, at that location a centrifugal force acts upon the dirt particles carried along in the air stream and displaces the particles radially outwardly out of the air stream. A fan wheel configured in this way thus performs the function of an air cleaning mechanism. In the region of the outer rim of the fan wheel a pressure compensation takes place between the two sides of the fan disk; that side of the fan disk that is remote from the cooling air blades is a clean air side where an air stream is present that is extensively cleaned of dirt particles and that has a speed-dependent pressure. Since in addition the speed and hence the pressure level of the air stream is greater in the peripheral region of the fan wheel than in the region of the fan axis, the pressure-obtaining opening is preferably disposed in the air stream on the clean air side of the fan disk at as great a radial distance from the fan axis as possible.

Pursuant to a further embodiment of the present invention, additional blades are provided on the clean air side of the fan disk for achieving a further centrifugal force cleaning of the conveyed air for use as air for combustion. Furthermore, in additional to increasing the degree of cleanness, the circumferential speed of the air speed also increases. In order to be able to tap as characteristic a pressure level as possible, the pressure-obtaining opening is preferably disposed on the clean air side of the fan disk and also, as viewed in the radial direction, between the fan axis and the inner radius of the further blades.

The diaphragm carburetor is constructed in such a way that an over pressure in the compensation chamber results in enrichment of the mixture. That end of the control pressure line on the cooling air side is therefore preferably embodied as an impact or pitot tube, on the end face of which is disposed the pressure-obtaining opening. The pitot tube itself is oriented in such a way that the pressure-obtaining opening is directed against the air stream. As a result of this arrangement, the control diaphragm is supplied with the overall pressure of the air stream via the control pressure line. Consequently, as the speed increases there results in the desired manner an enrichment of the air/fuel mixture. The overall pressure is comprised of the static pressure and the pressure head, and has a progressive pattern as a function of the stream velocity. The increase in pressure in the lower and middle speed range is slight, so that the internal combustion engine can be operated over a wide speed range at a lean mixture setting without enrichment. The fuel consumption and the discharge of pollutants are low. Due to the steep overall pressure rise at higher speeds, and the higher velocity of the air stream, a significant enrichment of the mixture ratio is effected only at high speeds and hence only when the speed threshold is achieved. There is thereby effected, due to the progressive pattern of the overall pressure, such a distinct enrichment that an effective speed limitation is ensured.

The impact tube is expediently embodied as a pitot tube and has a pressure-obtaining opening that is directed against the cooling air stream, and also has one or more static pressure openings disposed on the periphery of the pitot tube. As a result of the static pressure openings, the portion of the static pressure is compensated at the overall pressure, so that only the pressure head of the cooling air stream is present in the control pressure line and hence also at the control diaphragm. The pressure head varies quadratically with the flow velocity and hence essentially quadratically with the speed, whereby the pressure head on the one hand has the same advantages as regulation magnitude as does the overall pressure described above, and on the other hand a regulation of the mixture ratio is possible that is independent of the static pressure. To protect the internal combustion engine as well as the diaphragm carburetor, an intake air filter is provided, the clean air side of which is connected via a connecting passage with the compensation chamber of the diaphragm controller. The connecting passage serves for supplying the control diaphragm with the intake pressure that exists on the clean air side of the air filter, whereby also the degree of contamination of the air filter is compensated. Since the compensation chamber is also connected in a pressure transmitting manner with the air stream generated by the cooling fan, a balancing restrictor is provided to avoid an undesired feedback in the connecting passage, whereby an undesired high air throughput is prevented.

Further specific features of the present invention will be described in detail subsequently.

DESCRIPTION OF PREFERRED EMBODIMENTS

Figure 2:
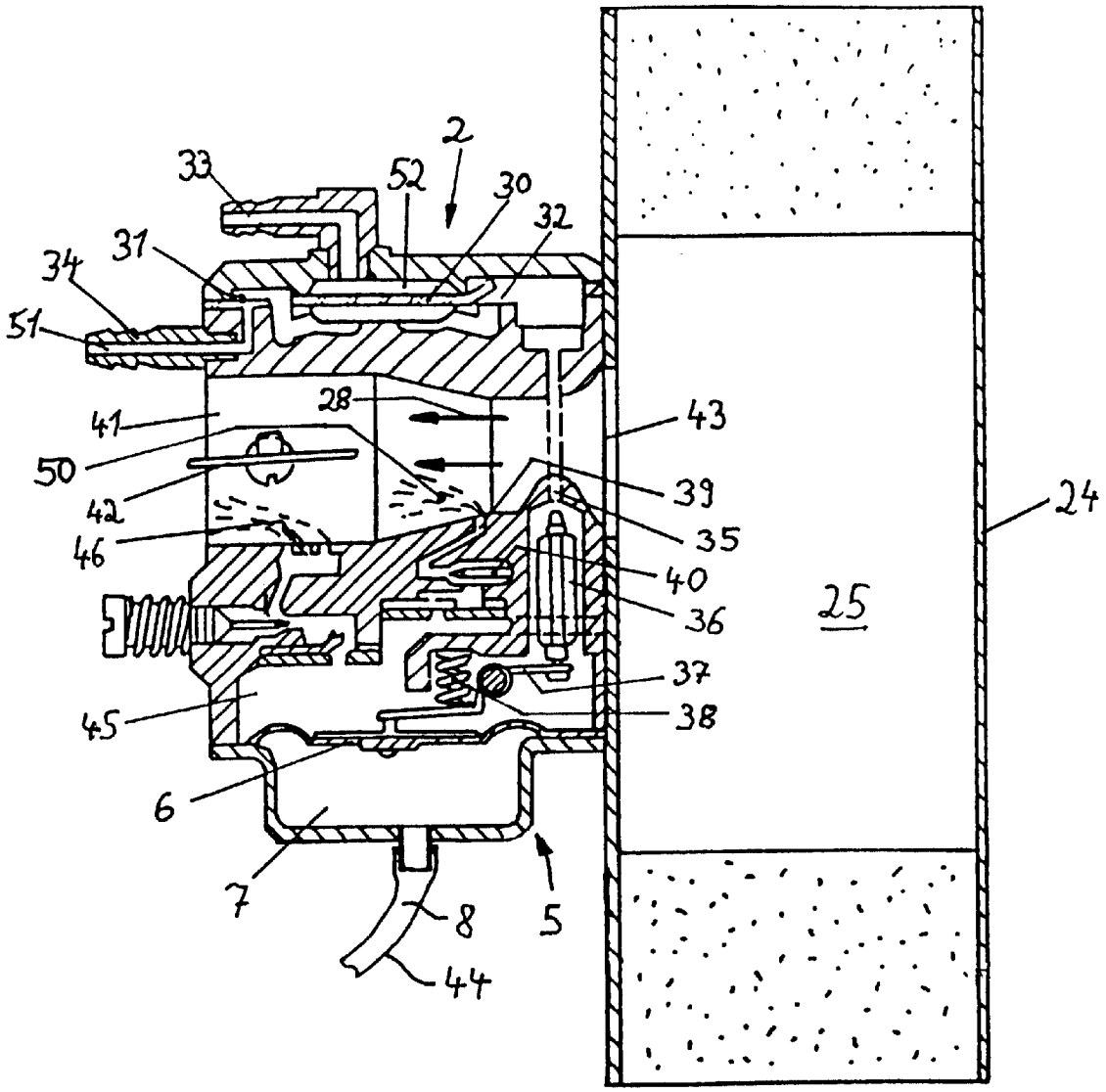
FIG. 2 is a cross-sectional view through a diaphragm carburetor for the internal combustion engine of FIG. 1.
Figure 3:
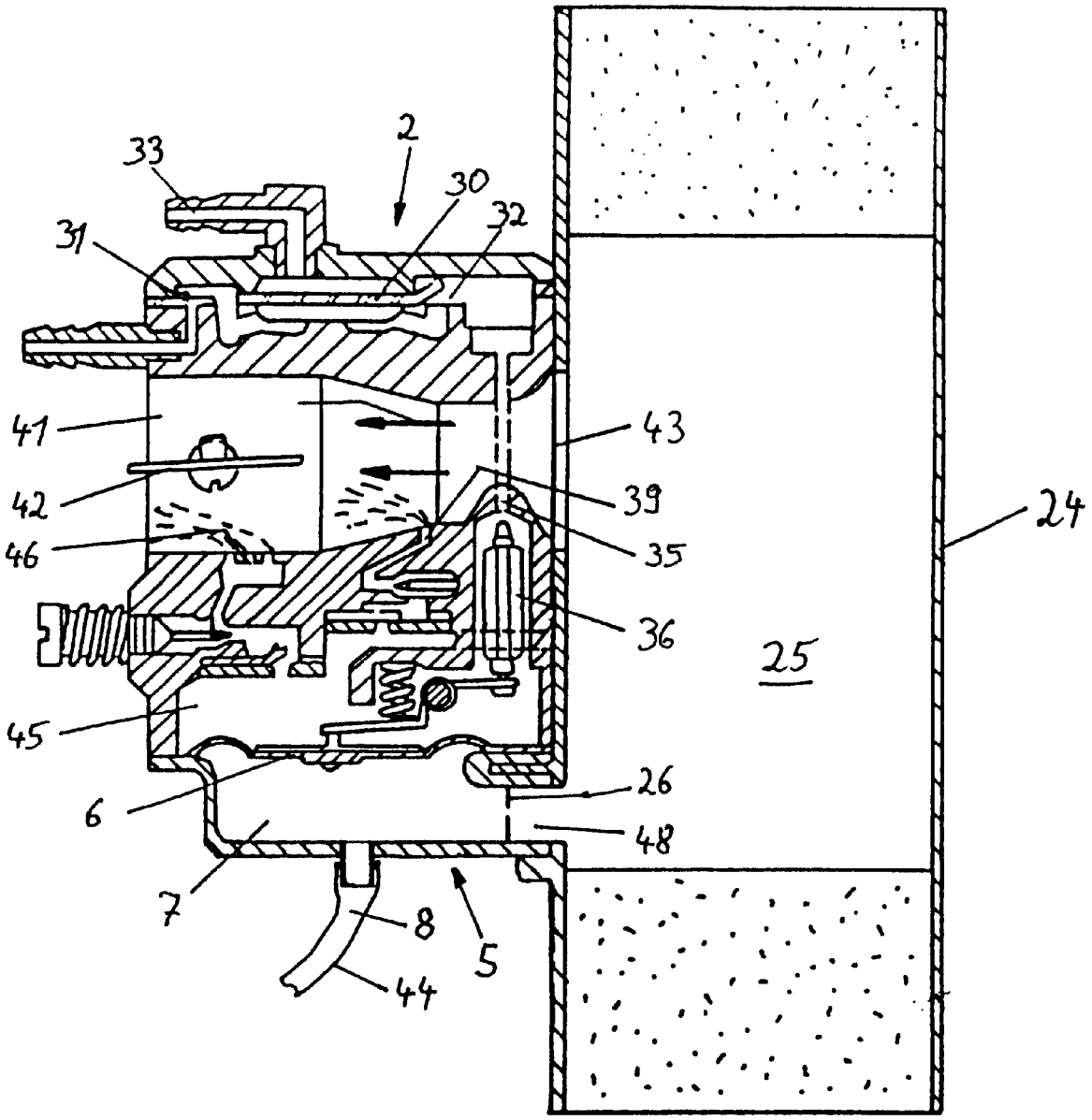
FIG. 3 is a cross-sectional view through a modified diaphragm carburetor according to FIG. 2.

A manually guided implement can be driven by a two-stroke engine having a valve control mechanism, or can be driven by a four-stroke engine. In FIG. 1 of the drawings, the internal combustion engine 1 that drives the implement is embodied as a two-stroke engine. The internal combustion engine 1 has a diaphragm carburetor 2 and a cooling fan 4. The cooling fan is embodied as a radial fan 13 having a fan wheel 14, with cooling air blades 18 being disposed on one side of the fan wheel 14. The fan wheel operates in a fan housing 23, a portion of which is embodied as a fan spiral 29, which is illustrated by cross-hatching in the drawing. The cooling fan 4 conveys an air stream 3, a major portion of which is conveyed as a cooling air stream to the cylinder 47 via the fan spiral 29. The internal combustion engine 1 draws in air for combustion via the diaphragm carburetor 2 and the intake air filter 24 that is associated therewith. In the illustrated embodiment, the combustion air stream, which is indicated by the arrow 28, is a portion of the air stream 3 that is generated by the cooling fan 4. As shown in FIGS. 2 and 3, the diaphragm carburetor 2 has a fuel-filled control chamber 45 with a control diaphragm 6. Provided on the dry side of the control diaphragm 6 of the diaphragm controller 5 is a compensation chamber 7 to which a control pressure line 8 is connected. The end 10 of the control pressure line 8 (see FIGS. 1 and 4), which end 10 is remote from the diaphragm carburetor 2, is provided with a pressure-obtaining opening 11 that is disposed in the vicinity of the air stream 3. In the illustrated embodiment, the end 10, which is on the side of the air stream, is disposed in the region of the fan wheel 14; however, it could also be provided in the region of the fan spiral 29 or in the region of the combustion air stream, which is illustrated by the arrow 28.

FIG. 2 shows a carburetor arrangement with a diaphragm carburetor 2 and an intake channel 41. The end 43 of the intake channel 41 that is at the side where the air filter is located is connected with the clean air side 25 of the intake air filter 24, by means of which the internal combustion engine 1 (FIG. 1) draws in air for combustion in the direction of the arrows 28. Fuel 51 flows into the carburetor 2 via a fuel connector 34. The fuel 51 is conveyed by a diaphragm pump 52, which includes a pump diaphragm 30, an inlet valve 31 and an outlet valve 32. The diaphragm pump 52 is supplied by a crankcase pressure line 33 with the pressure that is changing in the crankcase. The fuel feed into the control chamber 45 is controlled via a feed valve 35 by a control diaphragm 6, which separates the control chamber 45 from the compensation chamber 7. The compensation chamber is supplied via the control pressure line 8 with the pressure that exists in the air stream 3 (FIG. 1). The control diaphragm 6 is connected via a valve lever 37 with the valve body 36 of the feed valve 35, through which the fuel flows to the control chamber 45. The feed valve 35 is spring loaded in the closed position by a valve spring 38 that acts upon the valve lever 37. As a function of the pressure difference on the two sides of the control diaphragm 6, the valve body 36 is moved against the preloading of the valve spring 38, and hence regulates the fuel feed. The fuel 51 flows out of the control chamber 45 via the main nozzle 39 into the intake channel 41. The main nozzle 39 can be embodied as a fixed nozzle, and in the illustrated embodiment is adjustable by means of a main adjustment screw 40. In the intake channel 41, the fuel 51 mixes with the combustion air stream 28 to form an air/fuel mixture 50. The throughput of the air/fuel mixture 50 through the carburetor 2 is controlled by a throttle or butterfly valve 42, which is illustrated in the full throttle position. To prepare an air/fuel mixture 50 in the idling position, an idling nozzle 46 is provided.

The control pressure line 8 can be embodied as a tube, as a connecting channel, or as an opening in a wall that separates the compensation chamber 7 from the region of the air stream 3; in the illustrated embodiment, the line 8 is advantageously a flexible hose 44.

FIG. 3 shows a carburetor arrangement that is modified over that shown in FIG. 2; with this embodiment, the compensation chamber 7 is connected via a connecting passage 48 in an air pressure transmitting manner with the clean air side 25 of the intake air filter 24. A balancing restrictor 26 is provided in the connecting passage 48. As a result, the control diaphragm 6 is also supplied in part with a reference pressure tapped from the clean air side 25 of the intake air filter 24. It is also possible to arrange the balancing restrictor 26 in such a way that a different reference pressure, for example in the form of the ambient pressure, acts in the compensation chamber 7.

FIG. 4 shows the cooling fan 4 of FIG. 1 in a cross-sectional view taken along the line IV—IV. The fan wheel 14 is mounted on the crankshaft 49 of the internal combustion engine 1, and is driven via this crankshaft by the internal combustion engine. The fan wheel 14 rotates about the fan axis 16 and has a circular disk-shaped fan disk 17 that forms a circular disk plane 14 that is disposed perpendicular to the fan axis 16. Disposed on that side of the fan disk 17 that faces away from the internal combustion engine 1 are the cooling air blades 18 for conveying the air stream 3 (FIG. 1). The fan wheel 14 is surrounded by the fan spiral 29, thereby forming an air cleaning mechanism 9. Disposed on the end face of the fan wheel 14 is a fan cover 52 that is provided with an intake air grating. That side of the fan disk 17 that faces away from the cooling air blades 18 forms a clean air side 12 on which the pressure-obtaining opening 11 on the air stream side end 10 of the control pressure line 8 is disposed at a radial spacing "a" relative to the fan axis 16. Disposed on that side of the fan disk 17 that faces away from the cooling air blades 18, beyond an inner radius $r_i$, on the rim of the disk 17, are further blades 19. The pressure-obtaining opening 11, when viewed in the radial direction, is disposed between the fan axis 16 and the inner radius $r_i$, preferably close to the inner radius $r_i$.

The end 10 of the control pressure line 8 on the air stream side can be a piece of hose or a tubular piece, and in the embodiment illustrated in FIG. 5 is in the form of an impact or pitot tube 20, at the end 21 of which the pressure-obtaining opening 11 is provided. The pitot tube 20 is oriented in such a way that the pressure-obtaining opening 11 faces against the air stream 3. A portion of the pressure control line 8 that is connected to the pitot tube 20 is embodied as a flexible hose 44. The pitot tube 20 can be a separate metal part, but is preferably embodied integrally or monolithically with the fan housing 23, and is in particular made of polymeric material.

FIG. 6 shows a variation of the pitot tube 20 of FIG. 5 in that the periphery of the pitot tube 20 is provided with static pressure openings 22 that are connected in an air pressure transmitting manner with the pressure-obtaining opening 11. The remaining features and reference numerals correspond to those of the embodiment of FIG. 5.

The specification incorporates by reference the disclosure of German priority document 199 41 981.7 of Sep. 3, 1999.

The present invention is, of course, in no way restricted to the specific disclosure of the specification and drawings, but also encompasses any modifications within the scope of the appended claims.

What I claim is:

1. A manually guided implement having an internal combustion engine, comprising:

a diaphragm carburetor for supplying a fuel/air mixture to the internal combustion engine, wherein the diaphragm carburetor has a fuel-filled control chamber, a compensation chamber, and a control diaphragm that separates the control chamber and the compensation chamber;

a cooling fan that is driven by said internal combustion engine and generates an air stream, wherein said cooling fan is embodied as a radial fan having a fan wheel with a fan disk that rotates about a vertical fan axis and is provided on one side with cooling air blades;

a control pressure line for establishing communication, in an air pressure transmitting manner, between a region of said air stream and said compensation chamber of said diaphragm carburetor, wherein said control pressure line branches off from a side of said fan disk that is remote from said cooling air blades;

an air cleaning mechanism provided in said air stream, wherein an air stream end of said control pressure line is provided with a pressure-obtaining opening that is disposed on a clean air side of said air cleaning mechanism; and further blades provided on a backside of said fan disk that faces away form said cooling air blades, wherein said pressure-obtaining opening is disposed between said fan axis and an inner radius of said further blades.

2. An implement according to claim 1, wherein said pressure-obtaining opening is disposed close to said inner radius.

3. An implement according to claim 1, wherein said air stream end of said control pressure line is embodied as a pilot tube, and wherein said pressure-obtaining opening is disposed so as to face said air stream.

4. An implement according to claim 3, wherein a portion of said control pressure line is embodied as a flexible hose.

5. A manually guided implement having an internal combustion engine, comprising:

a diaphragm carburetor for supplying a fuel/air mixture to the internal combustion engine, wherein the diaphragm carburetor has a fuel-filled control chamber, a compensation chamber, and a control diaphragm that separates the control chamber and the compensation chamber;

a cooling fan that is driven by said internal combustion engine and generates an air stream;

a control pressure line for establishing communication, in an air pressure transmitting manner, between a region of said air stream and said compensation chamber of said diaphragm carburetor; and an air cleaning mechanism provided in said air stream, wherein an air stream end of said control pressure line is provided with a pressure-obtaining opening that is disposed on a clean air side of said air cleaning mechanism, wherein said air stream end of said control pressure line is embodied as a pitot tube, wherein said pressure-obtaining opening is disposed so as to face said air stream and, wherein static pressure openings are provided on a periphery of said pitot tube.

6. An implement according to claim 5, wherein said cooling fan is embodied as a radial fan having a fan wheel with a fan disk that rotates about a vertical fan axis and is provided on one side with cooling air blades, and wherein said control pressure line branches off from a side of said fan disk that is remote from said cooling air blades.

7. An implement according to claim 6, wherein said pressure-obtaining opening of said control pressure line is disposed in said air stream at a radial distance relative to said fan axis.

8. An implement according to claim 6, wherein said pressure-obtaining opening is disposed on said side of said fan disk that is remote from said cooling air blades.

9. A manually guided implement having an internal combustion engine, comprising:

a diaphragm carburetor for supplying a fuel/air-mixture to the internal combustion engine, wherein the diaphragm carburetor has a fuel-filled control chamber, a compensation chamber, and a control diaphragm that separates the control chamber and the compensation chamber;

a cooling fan that is driven by said internal combustion engine and generates an air stream, wherein said cooling fan is disposed in a fan housing;

a control pressure line for establishing communication in an air pressure transmitting manner, between a region of said air stream and said compensation chamber of said diaphragm carburetor; and an air cleaning mechanism provided in said air stream, wherein an air stream end of said control pressure line is provided with a pressure-obtaining opening that is disposed on a clean air side of said air cleaning mechanism, wherein said air in stream end of said control pressure line is embodied as a pitot tube, wherein said pressure-obtaining opening is disposed so as to face said air stream, and wherein said pitot tube is monolithically formed with said fan housing.

10. A manually guided implement having an internal combustion engine, comprising:

a diaphragm carburetor for supplying a fuel/air mixture to the internal combustion engine, wherein the diaphragm carburetor has a fuel-filled control chamber, a compensation chamber, and a control diaphragm that separates the control chamber and the compensation chamber;

a cooling fan that is driven by said internal combustion engine and generates an air stream;

a control pressure line for establishing communication, in an air pressure transmitting manner, between a region of said air stream and said compensation chamber of said diaphragm carburetor; and an intake air filter for air for combustion, wherein a clean air side of said intake air filter is connected in a pressure transmitting manner via a balancing restrictor with said compensation chamber of said diaphragm carburetor.

11. An implement according to claim 10, wherein an air cleaning mechanism is provided in said air stream, and wherein an air stream end of said control pressure line is provided with a pressure-obtaining opening that is disposed on a clean air side of said air cleaning mechanism.

* * * * *